United States Patent [19]

Kness et al.

[11] Patent Number: 4,707,916

[45] Date of Patent: Nov. 24, 1987

[54] SHAVER HEAD FOR A DRY SHAVER

[75] Inventors: Werner Kness, Völkermarkt; Karl Knees, Klagenfurt, both of Austria

[73] Assignee: U.S. Philips Corporation, New York, N.Y.

[21] Appl. No.: 856,915

[22] Filed: Apr. 28, 1986

[30] Foreign Application Priority Data

May 2, 1985 [AT] Austria ..... 1311/85

[51] Int. Cl.[4] ..... B26B 19/02

[52] U.S. Cl. ..... 30/43.92; 30/346.51

[58] Field of Search ..... 30/43.92, 43.91, 43.9, 30/43.8, 346.51

[56] References Cited

U.S. PATENT DOCUMENTS

| | | | |
|---|---|---|---|
| 4,170,060 | 10/1979 | Seidel et al. | 30/43.92 |
| 4,271,590 | 6/1981 | Ernst et al. | 30/43.92 |
| 4,424,628 | 1/1984 | Groothuis et al. | 30/43.92 |
| 4,578,861 | 4/1986 | Schweingruber et al. | 30/43.92 |

*Primary Examiner*—Douglas D. Watts

*Attorney, Agent, or Firm*—Thomas A. Briody; William J. Streeter; Rolf E. Schneider

[57] ABSTRACT

A shaver head with a shaver head frame (1), which supports a curved, perforated shaver foil (2) which is fitted by means of its apertures (11, 12) provided in the vicinity of its longitudinal edges onto hooks (7, 8) projecting from the longitudinal sections (3, 4) of the shaver head frame. The perforated shaver foil is provided on its outer side facing the longitudinal sections of the shaver head frame in the vicinity of each of its two longitudinal edges with at least one projecting attachment (13, 14), spaced apart from the free end (15, 16) of the adjacent longitudinal section, which is smaller than the depth (t) of the hooks projecting from the longitudinal sections and which with its upward extension projects at least into the dimensional range (w) of the wall thickness of the longitudinal sections in the vicinity of their free ends (FIG. 1).

4 Claims, 3 Drawing Figures

SHAVER HEAD FOR A DRY SHAVER

The invention relates to a shaver head for a dry shaver with a shaver head frame having two longitudinal sections and two side walls the frame supports a curved, perforated shaver foil, which in the vicinity of its two longitudinal edges possibly bears reinforcement strips is in each case with at least two apertures lying at a distance from each other, by which it is fitted onto hooks projecting from the two longitudinal sections. The hooks ends point away from the curvature of the perforated shaver foil. Such shaver heads are used in dry shavers available on the market, which have a lower blade movable backwards and forwards, which operates in conjunction with the perforated shaver foil of the shaver head. To clean the dry shaver the shaver head must be removed, with the risk that the perforated shaver foil slips off the hooks on the shaver head frame and thus has to be fitted back on to the hooks, which might easily result in damage to the sensitive perforated shaver foil. In order to prevent the perforated shaver foil from slipping off the hooks, projections were already provided on the longitudinal sections of the shaver head frame, lying opposite the two longitudinal edges of the perforated shaver foil at a slight distance and thus restricting the possible displacement path of the perforated shaver foil. Such projections do, however, have disadvantages. They render the mounting of the perforated shaver foil on the shaver head frame more difficult and the manufacture of the shaver head frame more complicated and more laborious because, for example, in the manufacture of the shaver head frame by injection moulding the tool used must be provided with clearances at those places where the projections are to be provided, which increases the tooling costs.

SUMMARY OF THE INVENTION

The object of the invention is to ensure a secure lodging of the perforated shaver foil on the shaver head frame with the simplest possible design shaver head frame, of the shaver head and a simple mounting of the perforated shaver foil on the shaver head frame. This is achieved according to the invention with a perforated shaver foil provided on its outer side facing the longitudinal sections of the shaver head frame in the vicinity of each of its two longitudinal edges with at least one projecting attachment. The distance of the attachment from the free end of the adjacent longitudinal section is smaller than the depth of the hooks projecting from the longitudinal sections, and which with its upward extension projects at least into the dimensional range of the wall thickness of the longitudinal sections in the vicinity of their free ends. In this way the projecting attachments on the perforated shaver foil restrict its possible displacement path so that it cannot simply slip off the hooks. If the perforated shaver foil is to be removed intentionally from the shaver head frame, pressure must be exerted by hand onto the projecting attachments from the outside, as a result of which the perforated shaver foil bends inward and detaches itself from the hooks. the fitting of the perforated shaver foil on the shaver head frame is also very simple, since apart from the hooks, which correspond with the apertures in the perforated shaver foil and thus do not constitute an obstacle. There are no other projections on the longitudinal sections of the shaver head frame which are in the way, so that it can fitted onto the hooks by means of its apertures without hindrance. The shaver head frame itself is of simple construction, as no further projections have to be provided on it other than the hooks.

It has proven to be very advantageous for the attachments provided in the vicinity of the two longitudinal edges of the perforated shaver foil to have the form of panels running parallel to the free ends of the adjacent longitudinal sections of the shaver head frame. Such panels securely restrict the possible displacement path of the perforated shaver foil on the shaver head frame and offer an excellent bearing surface for the deliberate detachment of the perforated shaver foil from the shaver head they also offer a reinforcement of the perforated shaver foil in the vicinity of its longitudinal edges.

In this context it has proven to be particularly advantageous for the panels to extend over the whole length of the perforated shaver foil. In this way the aforementioned advantages are made particularly evident.

It has also proven to be advantageous for the upward extension of the projecting attachments provided in the vicinity of the two longitudinal edges of the perforated shaver foil to be essentially equal to the wall thickness of the longitudinal sections in the vicinity of their free ends. In this way the possible displacement path of the perforated shaver foil on the shaver head frame is particularly securely restricted, since a relatively sharp inward bending of the perforated shaver foil is required in order to detach this from the hooks, which could definitely not occur unintentionally.

DESCRIPTION OF THE FIGURES

The invention will be described in further detail with reference to the diagram, which shows two exemplary embodiments of the invention.

DESCRIPTION OF THE PREFERRED EMBODIMENT

Figure 1:
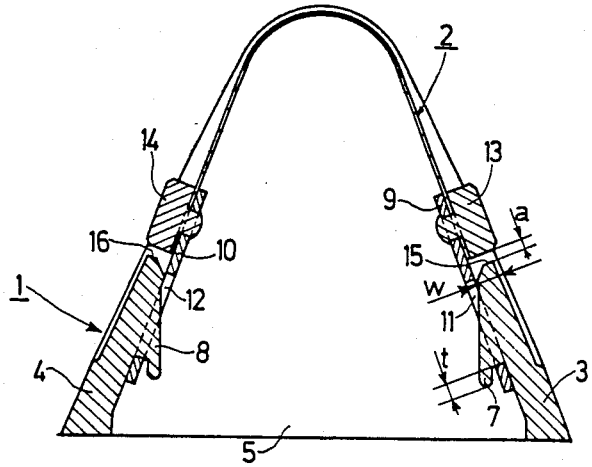
FIG. 1 shows a shaver head in cross section.
Figure 2:
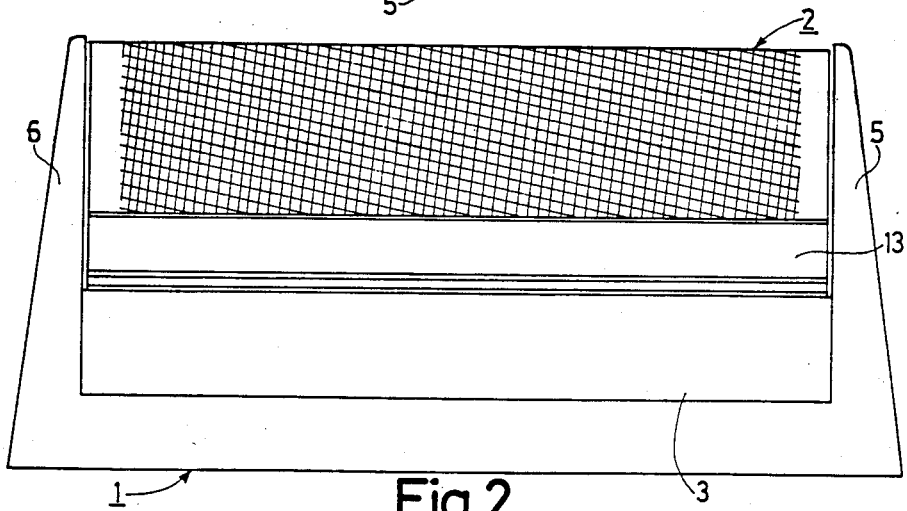
FIG. 2 shows the shaver head frame according to FIG. 1 in plan view onto one of the longitudinal sections of the shaver head frame, whereby the projecting attachments of the perforated shaver foil have the form of panels according to a first embodiment.

The shaver head shown in FIGS. 1 and 2 has a shaver head frame 1, which supports a curved perforated shaver foil 2. The shaver head frame 1 consists of two longitudinal sections 3 and 4 and two side walls 5 and 6. On the longitudinal sections 3 and 4 there are arranged in each case, as is customary, two hooks spaced some distance apart, projecting inwards and pointing away from the curvature of the perforated shaver foil 2, of which one hook, 7 and 8 respectively, is visible in each case in FIG. 1. The perforated shaver foil 2 is provided in this particular embodiment in the vicinity of its two longitudinal edges with in each case one reinforcement strip, 9 and 10 respectively, each of which is provided with two apertures lying at some distance from each other, of which one aperture, 11 and 12 respectively, is visible in each case in FIG. 1. These apertures 11 and 12 and the hooks 7 and 8 on the longitudinal sections 3 and 4 respectively correspond to each other in their position, so that the perforated shaver foil can be fitted onto the hooks by means of these apertures, whereby it is then curved and under the tension caused by the curvature is supported laterally on the internal walls of the corresponding longitudinal sections 3 and 4 by its outer side facing the longitudinal sections of the shaver head frame. Such reinforcement strips 9 and 10 are not of course absolutely essential, the apertures could be provided directly on the perforated shaver foil.

The perforated shaver foil 2 is now provided on its outer side facing the longitudinal sections 3 and 4 of the shaver head frame 1 with in each case one projecting attachment, 13 and 14 respectively, in the vicinity of its two longitudinal edges, by which is to be understood those areas which laterally border the perforated zone of the shaver foil designed for shaving. These attachments 13 and 14 have a distance a from the free ends 15 and 16 of the adjacent longitudinal sections 3 and 4 of the shaver head frame 1 which is smaller than the depth t of the hooks 7 and 8 projecting from the longitudinal sections 3 and 4. Since these attachments 13 and 14 are arranged on the outer side of the perforated shaver foil facing the longitudinal sections 3 and 4 of the shaver head frame, by which foil they are supported on the internal wall of the corresponding longitudinal section, they project with their upward extension into the dimensional range w of the wall thickness of the longitudinal sections 3 and 4 in the vicinity of their free ends 15 and 16.

In this way the perforated shaver foil 12 is held securely on the shaver head frame. If, for example, pressure is exerted on the curvature of the perforated shaver foil from the outside, the perforated shaver foil together with its reinforcement strips 9 and 10 will endeavour to move along the inner walls of the adjacent longitudinal sections 3 and 4 in the direction of the hooks 7 and 8. Such a displacement is subject to a limit however, because the projecting attachments 13 and 14 abut against the free ends 15 and 16 of the corresponding longitudinal sections 3 and 4 respectively as a result of their upward extension projecting into the dimensional range w of the wall thickness of the longitudinal sections 3 and 4 in the vicinity of their free ends 15 and 16. Since the distance a of the projecting attachments 13 and 14 from the free ends 15 and 16 of the adjacent longitudinal sections 3 and 4, over which a displacement of the perforated shaver foil is possible, is made smaller than the depth t of the hooks 7 and 8 projecting from the longitudinal sections, it is ensured that the apertures 11 and 12 cannot detach themselves from the hooks 7 and 8, because they remain within the area of the hooks. It is thus impossible for the perforated shaver foil to detach itself from the shaver head frame.

Should however a pressure be exerted by hand onto the attachments 13 and 14 from the outside, under the bending inwards of the perforated shaver foil 2 the reinforcement strips 9 and 10 are moved around their place of rest inside the hooks 7 and 8. In the course of this movement the projecting attachments 13 and 14 move gradually further away in respect of their upward extension from the dimensional range w of the wall thickness of the longitudinal sections 3 and 4 in the vicinity of their free ends 15 and 16 until finally the attachments 13 and 14 are released from these free ends 15 and 16. As soon as this is the case, the apertures 11 and 12 can detach themselves from the hooks 7 and 8, by which the perforated shaver foil 2 is released from the shaver head frame 1 because its displacement path is no longer restricted. In practice a slight pressure on the attachments 13 and 14 is sufficient to release the perforated shaver foil from the shaver head frame, since this process is supported by the efforts of the curved shaver foil to relax.

In this way it is ensured that the perforated shaver foil can on the one hand be securely held on the shaver head frame and on the other hand can be detached from it simply. Nor does the fitting of the perforated shaver foil on the shaver head frame meet with any difficulties and may be carried out either from above or below the frame. Should fitting from above the frame be selected, the perforated shaver foil is introduced into the shaver head frame with a longitudinal edge forward and fitted onto the hooks of the corresponding longitudinal section by means of the apertures, after which the perforated shaver foil is bent and introduced with the other longitudinal edge forward into the shaver head frame and again fitted onto the hooks of the other longitudinal section by means of the apertures. In the case of fitting from below the shaver head, the perforated shaver foil is first of all bent and inserted into the shaver head frame with the curvature forward and then fitted onto the hooks by means of the apertures. Since the internal walls of the longitudinal sections 3 and 4 are flat apart from the hooks 7 and 8, which correspond with the apertures 11 and 12 of the perforated shaver foil and do not therefore constitute an obstacle to the fitting of the perforated shaver foil into the shaver head frame, the perforated shaver foil can be fitted very simply onto the hooks 7 and 8 by means of its apertures 11 and 12.

As can be seen from FIG. 1, in this particular embodiment the upward extension of the projecting attachments 13 and 14 has been selected to ensure that it is essentially equal to the wall thickness w of the longitudinal sections 3 and 4 in the vicinity of its free ends 15 and 16. In this way a particularly firm restriction of the possible displacement path of the perforated shaver foil 2 is obtained, since the projecting attachments 13 and 14 come to lie securely against the free ends 15 and 16 of the longitudinal sections 3 and 4 respectively as a result of outside pressure on the curvature of the perforated shaver foil and a relatively sharp inward bending of the perforated shaver foil is necessary to release the attachments 13 and 14 from the free ends 15 and 16 of the longitudinal sections 3 and 4, only as a result of which can the perforated shaver foil be detached from the hooks 7 and 8.

There are a range of possibilities for the design of the projecting attachments 13 and 14 within the scope of the invention. Thus FIG. 2 shows an embodiment in which these attachments 13 and 14 take the form of panels which run parallel to the free ends 15 and 16 of the adjacent longitudinal sections 3 and 4 of the shaver head frame. In FIG. 2 such an attachment 13 is visible, which in this case takes the form of a panel extending over the complete length of the perforated shaver foil 2. With such panels it is possible to obtain a very firm restriction of the possible displacement path of the perforated shaver foil 2, since the panels can come to lie along their whole longitudinal extension against the free ends 15 and 16 of the adjacent longitudinal sections 3 and 4 respectively. Due to their large surface area they also provide an excellent bearing surface if pressure has to be exerted by hand in order to detach the perforated shaver foil from the shaver head frame. Such panels also offer the advantage that they provide a reinforcement of the perforated shaver foil in the vicinity of its longitudinal edges.

Figure 3:
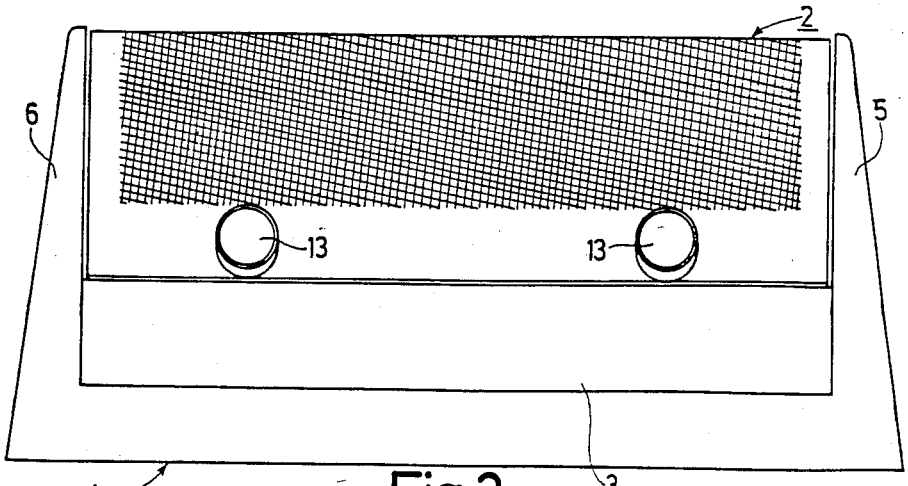
FIG. 3 shows a second embodiment, according to which the projecting attachments on the perforated shaver foil have the form of cylinders.

To illustrate another possibility in respect of the design of the projecting attachments 13 and 14, FIG. 3 shows an embodiment in which two projecting attachments are provided in the vicinity of each longitudinal edge of the perforated shaver foil 2, which viewed in the longitudinal direction of the perforated shaver foil 2 lie side by side at a distance and are formed by cylinders with circular cross section. In FIG. 3 two of these attachments 13 are visible. It would of course be possible to have a different cross-sectional shape such as, for example, elliptical or prismatic. It would be equally possible to have more than two projecting attachments in the vicinity of each longitudinal edge of the perforated shaver foil, such as, for example, three or four. Such designs would also ensure a secure holding of the perforated shaver foil on the shaver head frame, whereby the perforated shaver foil could once again be simply mounted or detached from the shaver head frame.

With regard to the inclusion of the projecting attachments 13 and 14 on the perforated shaver foil 2, it should be mentioned that a range of possibilities also exists for this within the framework of the definitive state of the art, whereby the choice of material from which the attachments are to be made also plays a role. If the attachments are made of metal, they may be adhered, for example, by means of a metal adhesive to the perforated shaver foil also made of metal. In manufacturing it has proven to be very simple for the attachments on the perforated shaver foil to be riveted on at several points. Should the perforated shaver foil also be provided with reinforcement strips in the vicinity of its longitudinal edges it is possible, for example, to extend the reinforcement strips into the region of the attachments and to carry out the riveting such that it simultaneously joins the reinforcement strips and the attachments with the perforated shaver foil, whereby the perforated shaver foil then comes to lie between the attachments and the reinforcement strips, as is shown in FIG. 1. If the attachments are made of plastic, they may be welded to the perforated shaver foil by ultrasonic means or crimped on under the effect of heat on the perforated shaver foil. Should the perforated shaver foil also be provided with reinforcement strips of plastic in the vicinity of its longitudinal edges, in which case the attachments would also be made of plastic, the attachments and the reinforcement strips could also be injection-moulded directly on the perforated shaver foil as single-piece parts.

As is clear from the above, a series of variations of the described embodiments exists without exceeding the scope of the invention.

What is claimed is:

1. A shaver head for a dry shaver comprising:

a shaver head frame having two longitudinal sections subtended by two opposite side walls, each of said longitudinal sections supporting on an inner surface thereof a downwardly extending hook member; and a shaver foil having a perforated portion curved about a line midway between first and second longitudinal ends, said first and second longitudinal ends forming with said longitudinal sections an enclosure, said longitudinal ends including an aperture for receiving one of said hook members, and said longitudinal ends including above each of said apertures a projection attachment having an edge spaced apart from a respective longitudinal section a distance smaller than the depth of said hook member, said attachment having a width that is substantially the same as the width of an end of said longitudinal sections, whereby said perforated foil can be removed from said hooks by pressing sid foil longitudinal ends towards each other.

2. The shaver head of claim 1 wherein said perforated foil along its longitudinal edges includes reinforcing strips.

3. Shaver head according to claim 1, wherein the attachments provided in the vicinity of the two longitudinal edges of the perforated shaver foil have the form of panels running parallel to the free ends of the adjacent longitudinal section of the shaver head frame.

4. Shaver head according to claim 3, characterized in that the panels extend over the whole length of the perforated shaver foil.

* * * * *